United States Patent [19]

Jencks et al.

[11] 4,097,831

[45] Jun. 27, 1978

[54] CIRCUIT BREAKER ACCESSORY TRIPPING APPARATUS

[75] Inventors: Charles L. Jencks, Avon; Roger N. Castonguay, Terryville, both of Conn.

[73] Assignee: General Electric Company, New York, N.Y.

[21] Appl. No.: 761,115

[22] Filed: Jan. 21, 1977

[51] Int. Cl.[2] ..... H01H 9/20

[52] U.S. Cl. ..... 335/166; 335/20; 335/174

[58] Field of Search ..... 335/20, 169, 170, 171, 335/174, 166, 173

[56] References Cited

U.S. PATENT DOCUMENTS

| | | | |
|---|---|---|---|
| 3,919,674 | 11/1975 | Acampora et al. | 335/20 |
| 4,001,742 | 1/1977 | Jencks et al. | 335/173 |
| 4,061,993 | 12/1977 | Hennemann | 335/20 |

*Primary Examiner*—George Harris

*Attorney, Agent, or Firm*—Robert A. Cahill; Walter C. Bernkopf

[57] ABSTRACT

An accessory apparatus package for electric circuit breakers includes a pivotal lever for latching a spring powered trip slide in a reset position. Either of two shunt trip solenoids acts on this lever to unlatch the slide, which springs to an actuated position, initiating tripping of the breaker. A UVR solenoid can also act on this lever to unlatch the slide. A powerful reset spring, controlled by the breaker operating mechanism, discharges as the breaker trips to return the slide to its reset position and, in the process, causes the lever and the solenoid plungers to be reset. All parts are operatively mounted by a common support affixed to the breaker.

21 Claims, 6 Drawing Figures

FIG. 1
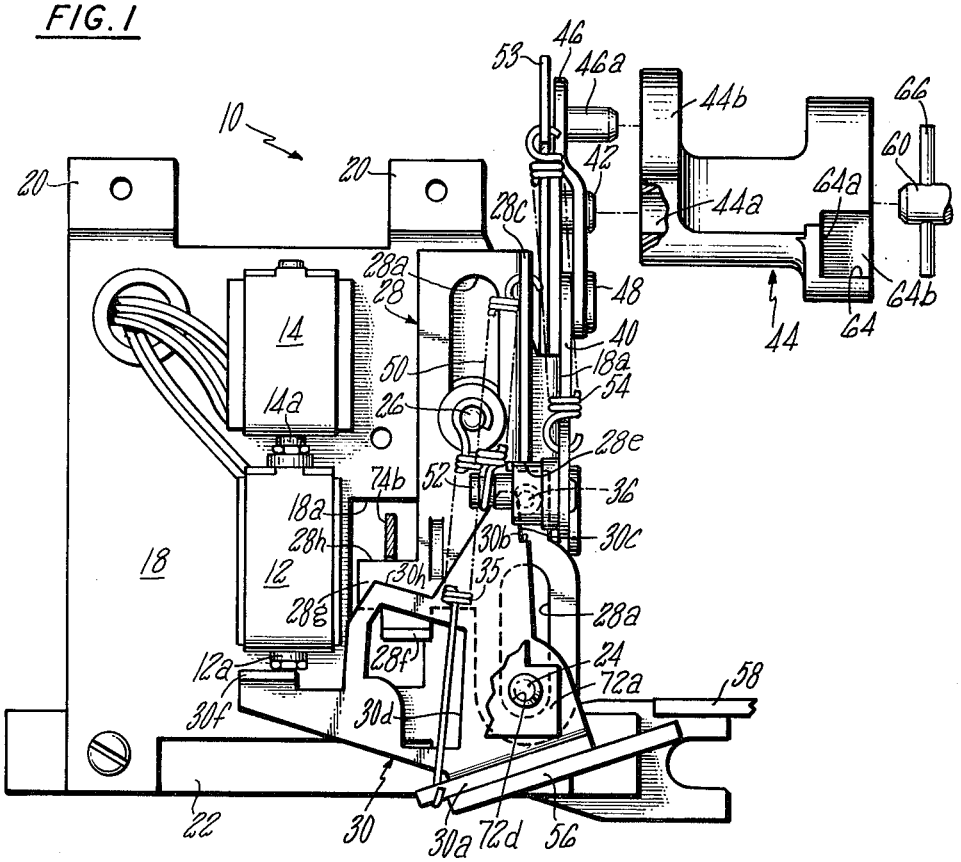
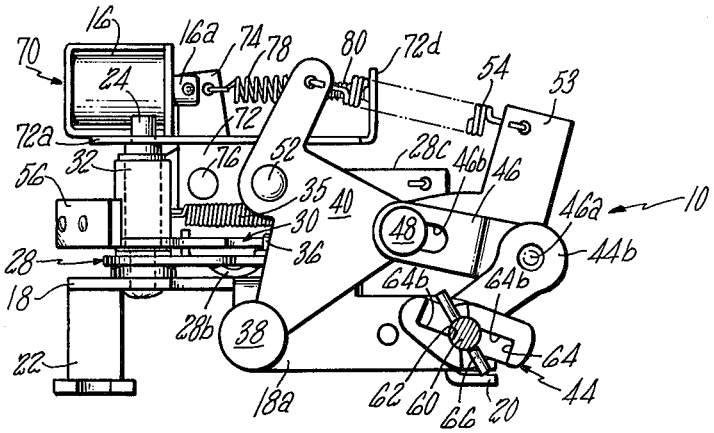
FIG. 2

FIG. 5
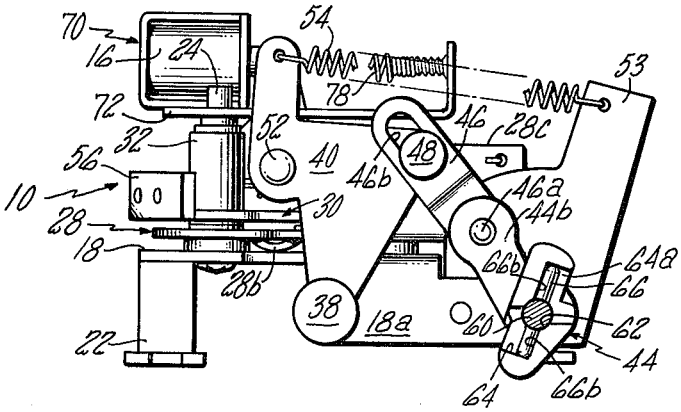
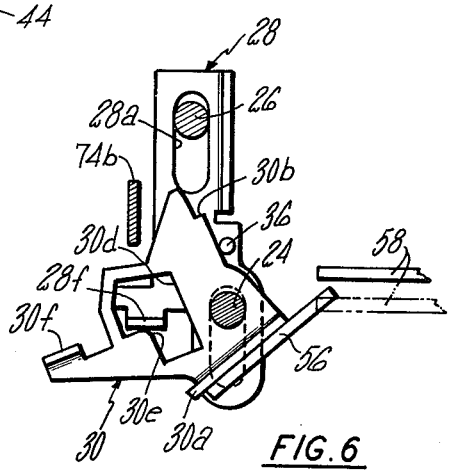
FIG. 6
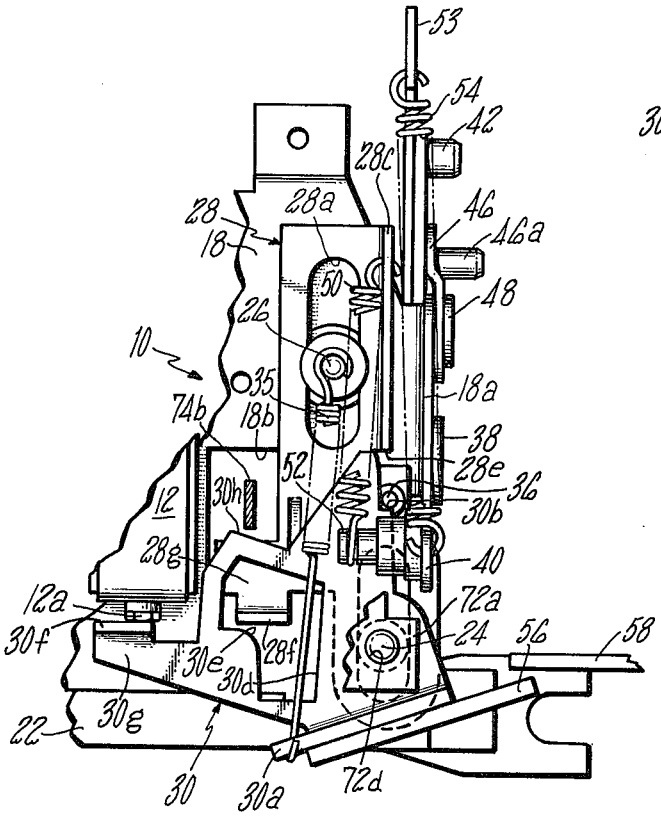
FIG. 4

CIRCUIT BREAKER ACCESSORY TRIPPING APPARATUS

BACKGROUND OF THE INVENTION

Accessory apparatus for selectively tripping an electric circuit breaker, particularly breakers utilized in industrial applications, are of various types. Probably the most common is the so-called "shunt trip" accessory which is typically utilized to trip a circuit breaker from a remote location, such as a central control panel. A shunt trip typically takes the form of a solenoid whose plunger is poised to trippingly engage the circuit breaker latch upon solenoid energization. The solenoid energization circuit is wired to a remote location where a switch is closed to produce solenoid energization and consequent tripping of the circuit breaker.

Another common circuit breaker accessory is a so-called "undervoltage release" (UVR) which is utilized to trip a circuit breaker in the event the line voltage falls significantly below a nominal level for a sustained, as contrasted to a momentary duration. A UVR is typically embodied in a solenoid which is energized by nominal line voltage to magnetically hold its plunger retracted or seated against the force of a return spring. When the line voltage drops below the level necessary to enable the UVR solenoid to overcome the return spring force, the plunger is pulled out to an extended position by the spring. This movement of the plunger is communicated to the circuit breaker latch, thereby effecting tripping of the breaker.

In some applications, the customer may desire a circuit breaker-fuse combination, wherein fuses are connected in series with the circuit breaker to increase the effective current interrupting capacity. In a three-phase circuit, a fuse is connected in series with each of the three circuit breaker poles. In the event one fuse blows to interrupt one phase of the circuit, it is important that the other two phases also be interrupted forthwith in order to prevent the damaging consequences of so-called "single phasing". To ensure against single phasing, a three-coil shunt trip solenoid can be incorporated in the circuit breaker. Each coil is connected across a different fuse, such that, when one fuse blows, current is diverted through the coil connected thereacross. The solenoid is thus actuated, causing its plunger to impact against the circuit breaker latch and trip the breaker to interrupt all three phases.

While the incorporation of any one of these accessory trip functions within the molded case of an industrial circuit breaker has been readily achieved, size and space limitations have made it extremely difficult to accommodate within the breaker case any two or all three of the above mentioned trip functions. Recently issued U.S. Pat. No. 3,919,674 disclosed an accessory apparatus capable of serving any one, two or all three of these accessory trip functions in a compact accessory package accommodatable within the molded case of an industrial circuit breaker. The present invention constitutes an improvement over the accessory package disclosed in this patent, particularly in terms of achieving reliable resetting of the UVR solenoid.

It is accordingly an object of the present invention to provide improved circuit breaker accessory apparatus universally adaptable to accommodate any one, several or all of a plurality of diverse accessory trip functions.

An additional object of the invention is to provide accessory apparatus of the above character where plural accessory trip functions are accommodated through a common assemblage of cooperative parts.

A further object is to provide accessory apparatus of the above character, wherein plural trip functions are independently resolved into the movement of a single component into tripping impact with a circuit breaker latch.

Another object is to provide accessory apparatus of the above character which, having precipitated a trip function, automatically resets itself in response to tripping of the circuit breaker.

Still another object is to provide accessory apparatus of the above character wherein accessory trip functions may be readily added or subtracted without modifying the basic operative components of the assembly.

Yet another object of the invention is to provide accessory apparatus of the above character which is compact in size, efficient in design, reliable in operation, and inexpensive to manufacture.

Other objects of the invention will become apparent from the detailed description to follow.

SUMMARY OF THE INVENTION

In accordance with the present invention, there is provided accessory apparatus capable of being readily incorporated within the molded case of an electric circuit breaker and capable of serving any one, several or all of a plurality of diverse accessory trip functions. The accessory apparatus utilizes a single support for mounting the operative components in compact assembly, thus facilitating its physical incorporation within the breaker case. More specifically, the support mounts a post which, in turn, pivotally mounts a latch lever adapted, while in its reset position, to latch a trip slide in its reset position. A trip spring is connected between the slide and a reset lever pivotally mounted to the support and is held in an actuated position to charge the trip spring by the breaker operating mechanism while in its contact closure condition. A reset spring connected between the reset lever and the support is also charged while the reset lever is held in its actuated position.

A first shunt trip solenoid, mounted by the support, acts via its plunger on the latch lever to unlatch the trip slide, which is then propelled by the trip spring toward an actuated position. In the process, the trip slide picks up the latch lever, pivoting it into tripping impact with the circuit breaker latch to trip the breaker. As the unlatched breaker operating mechanism acticulates to open the breaker contacts, the reset lever is released, and the reset spring abruptly discharges to pivot the reset lever from its actuated position to a reset position. In the process, the reset lever picks up the trip slide, returning it to its reset position. A return spring interconnected between the latch lever and the support serves to return the latch lever to its reset position when released by the return of the trip slide to its reset position. When the breaker operating mechanism is subsequently articulated pursuant to reclosure of the breaker contacts, the reset lever is coincidentally propelled to its actuated position, thereby recharging the reset spring and the trip spring as the latch lever latchably engages the trip slide.

An optional second shunt trip solenoid may be mounted on the support with its plunger in end-to-end alignment with the first trip solenoid plunger which acts directly on the latch lever. The second trip solenoid plunger then acts on the lever via the first solenoid plunger to unlatch the trip slide.

An optional sub-assembly may be added to the support to serve an undervoltage release (UVR) accessory trip function in conjunction with or to the exclusion of one or both of the accessory trip functions served by the first and second shunt trip solenoids. This sub-assembly includes a UVR solenoid which is linked to a lever disposed to act on the latch lever in a manner to also unlatch the trip slide. During resetting of the accessory apparatus, powered exclusively by the reset spring, the trip slide, in returning to its reset position, picks up and pivots the lever such as to firmly reseat the plunger of the UVR solenoid.

The invention accordingly comprises the features of construction, combinations of elements, and arrangements of parts which will be exemplified in the constructions hereinafter set forth, and the scope of the invention will be indicated in the claims.

For a better understanding of the nature and objects of the invention, reference should be had to the following detailed description taken in connection with the accompanying drawings, in which:

FIG. 1 is a plan view, partially broken away, of circuit breaker accessory tripping apparatus constructed in accordance with the present invention;

FIG. 2 is a side elevational view of the accessory tripping apparatus of FIG. 1;

FIG. 4 is a plan view, partially broken away, of the accessory tripping apparatus of the invention in its armed condition;

FIG. 5 is a side elevational view of the accessory tripping apparatus of FIG. 4; and FIG. 6 is a fragmentary plan view of parts of the accessory tripping apparatus in their respective actuated positions.

Like reference numerals refer to corresponding parts throughout the several views of the drawings.

DETAILED DESCRIPTION

Figure 3:
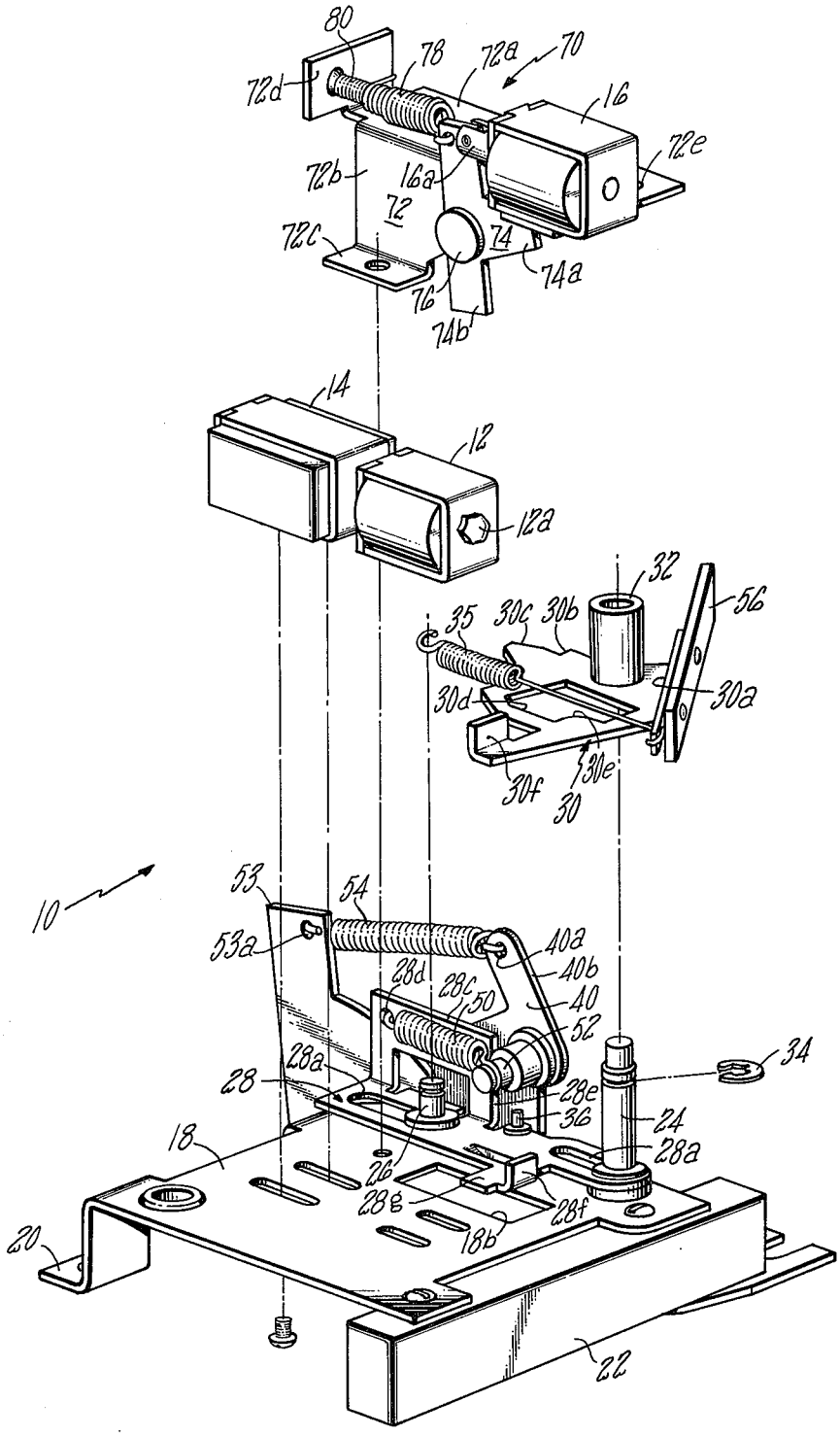
FIG. 3 is an exploded perspective view of the accessory tripping apparatus of FIG. 1.

The circuit breaker accessory tripping apparatus package of the present invention, generally indicated at 10 in the drawings, is illustrated in its embodiment accommodating three diverse trip functions, namely, shunt trip, three-coil shunt trip and undervoltage release (UVR). As will become apparent from the description to follow, the accessory package of the invention may be readily embodied to accommodate any one, two or all three of these trip functions. In this embodiment as best illustrated in FIG. 3, three trip solenoids, namely a shunt trip solenoid 12, a three-coil shunt trip solenoid 14 and a UVR trip solenoid trip 16, are mounted on a common support in the form of a platform 18 having turned down feet 20 at one end and a mounting block 22 at the other end facilitating mounting of the package within a circuit breaker case (not shown). Platform 18 in turn mounts a forwardly located, elongated upright post 24 and a rearwardly located, short upright post 26. These posts extend through elongated slots **28*a* formed in a trip slide, generally indicated at 28, and are fitted with suitable washers serving to mount and guide the trip slide for movement between a forward actuated position and a rearward reset position. A skid 28*b* lanced downwardly from the body of trip slide 28 bears against the upper surface of plate 18, as best seen in FIGS. 2 and 5**, to prevent tilting of the trip slide, thus to ensure smooth, non-binding sliding movement thereof.

A latch lever, generally indicated at 30 in FIG. 3, is provided with a hub 32 which is fitted on elongated post 24 pursuant to pivotally mounting the latch lever for movement between actuated and reset positions. A snap ring 34 maintains this pivotal mounting of the latch lever on post 24. A latch spring 35, hooked at its rearward end on post 26 and at its forward end to an upwardly turned flange **30*a* carried by latch lever 30, serves to bias the latch lever to its reset position (FIG. 4) where a latch shoulder 30*b* formed in the latch lever is disposed in latchably engaging relation with an upstanding latch pin 36 carried by trip slide 28. Under these circumstances, the slide is held in its reset position by virtue of the engagement of latch pin 36 against latch shoulder 30*b***.

Referring to FIGS. 2 and 5, a flange **18*a*, depending from the edge of platform 18 just beyond trip slide 28, carries a pin 38 serving to pivotally mount a reset lever 40. Flange 18*a* also mounts a stub shaft 42 (FIG. 1) which is received in a bore 44*a* formed in the body of a crank, generally indicated at 44. The crank includes an elongated crank arm 44*b* which is apertured adjacent its free end for receipt of a pin 46*a* carried at one end of a link 46. The other end of this link is provided with an elongated slot 46*b* through which extends a heading pin 48 carried by reset lever 40**.

Returning to FIG. 3, trip slide 28 is formed with an upstanding flange **28*c* in which is formed a hole 28*d* to receive the hooked rearward end of a trip spring 50. The other end of this tension spring is hooked on the inner end of a pin 52 carried by reset lever 40. An upstanding bracket 53 is riveted to the depending platform flange 18*a*. A hole 53*a* formed adjacent the upper extremity of this bracket receives the hooked rearward end of a reset spring 54. The forward end of this spring is hooked through a hole 40*a* formed in the extremity of an upwardly extending arm 40*b* integral with reset lever 40**.

The various parts described thus far are illustrated in FIGS. 1 and 2 in their respective reset positions; such positions having been achieved under the influence of reset spring 54. Specifically, the reset spring biases reset lever 40 to its clockwisemost, reset position. Pin 52, carried by the reset lever, engages the leading edge **28*e* of trip slide flange 28*c*, such that reset spring 54 also biases the trip slide to its rearward, reset position. Trip spring 50 is, under these circumstances, substantially discharged. As seen in FIG. 1, return spring 35 biases latch lever 30 to its clockwisemost reset position, with an edge 30*c* thereof leading to latch shoulder 30*b* engaging latch pin 36** to controllably position the latch shoulder in latchably engageable relation with the latch pin.

To arm the accessory tripping apparatus, crank 44 is rotated in the counterclockwise direction as viewed in FIGS. 2 and 5. The toggle constituted by crank arm **44*b* and link 46 begins to straighten, causing reset lever 40 to pivot in the counterclockwise direction which serves to charge reset spring 54. By virtue of the interconnection between trip slide 28 and reset lever 40 afforded by trip spring 50, counterclockwise pivotal movement of the reset lever causes the trip slide to move forwardly until its latch pin 36 engages latch shoulder 30*b* of the latch lever (FIG. 4). Continued counterclockwise pivotal movement of the reset lever by crank 44 causes the trip spring 50 to be charged since continued forward movement of the trip slide toward its actuated position is prevented by the latch lever. Crank 44 is rotated in the counterclockwise direction to the point where the toggle provided by link 46 and crank arm 44***b* are almost, but not quite straightened. At this point, reset lever 40 has achieved its actuated position, and the reset spring 54 and trip spring 50 are fully charged. Latch spring 35 establishes sufficient latching force which must be overcome to disengage latch shoulder 30*b* and latch pin 36 so as to preclude spurious unlatching. The accessory apparatus in its condition shown in FIGS. 4 and 5 is armed and ready to execute an accessory trip function.

Now if the latch lever 30 is pivoted in the counterclockwise direction (FIG. 4) against the bias of latch spring 35 sufficiently to swing latch shoulder 30*b* out of engaging relation with latch pin 36, trip spring 50 is free to discharge, and the trip slide is propelled to its actuated position. As seen in the plan views of FIGS. 1 and 4, a lateral extension 28*g* of the trip slide carries an upright tab 28*f* which protrudes through an opening 30*d* formed in latch lever 30. As the trip slide is propelled to its actuated position by the discharge of trip spring 50, tab 28*f*, as seen in FIG. 6, impacts against a rounded edge 30*e* of opening 30*d* in the latch lever, causing the latter to be pivoted counterclockwise to its actuated position. A paddle 56 affixed to the latch lever flange 30*a* is swung into tripping impact with a circuit breaker latch 58, thereby initiating circuit interruption. The rounded edge 30*e* of opening 30*d* in the lever against which of the trip slide tab 28*f* engages ensures smooth, non-binding coaction of the trip slide with the latch lever in achieving tripping impact of paddle 56 with circuit breaker latch 58.

As is fully described below, when the circuit breaker trips, the restraint on the clockwise pivotal movement of crank 44 is removed, and reset spring 54 is free to discharge, causing reset lever 40 to be propelled in the clockwise direction to its reset position. Pin 52 engages the leading edge 28*e* of flange 28*c*, thereby picking up the trip slide for rearward movement to its reset position under the influence of reset spring 54. Trip slide tap 28*f* releases latch lever 30, and latch spring 35 returns the latch lever to its reset position seen in FIGS. 1 and 2.

In accordance with a feature of the present invention, motivation for pivoting crank 44 pursuant to arming the accessory apparatus 10 is derived from the circuit breaker operating mechanism as it is being reset incident to reclosure of the breaker contacts. An exemplary circuit breaker operating mechanism capable of properly motivating crank 44 is disclosed in U.S. Pat. No. 4,001,742. The disclosure of this patent is specifically incorporated herein by reference. To this end, a shaft, illustrated at 60 in FIG. 1, which may be constituted by an extension of the breaker mechanism cradle pivot pin, is utilized to drive crank 44 in the counterclockwise direction coincidentally with articulation of the breaker mechanism pursuant to swinging the cradle around to its latched or reset position. The terminal end portion of shaft 60 is received in a bore 62 (FIG. 2 and 5) located in the crank body in coaxial alignment with bore 44*a* into which stub shaft 42 is received. The outer end of the crank body is formed with a transverse recess 64 accommodating a transverse pin 66 carried by shaft 60 when the terminal end portion of the shaft is inserted in bore 62. This recess is provided with diametrically opposed reliefs 64*a* (see also FIG. 1), such that clockwise rotation of the cradle pin extension shaft 60 is not coupled to the crank 44 (FIG. 2). However, counterclockwise rotation of the shaft 60 brings its transverse pin 66 into driving engagement with the diametrically opposed sides 64*b* of the crank recess 64, such that the crank is rotated in the counterclockwise direction in response to counterclockwise rotation of the shaft (FIG. 5).

In the reset condition of the accessory apparatus seen in FIGS. 1 and 2, the circuit breaker cradle is unlatched and the breaker contacts are open. As the breaker mechanism is articulated to reset the operating mechanism, i.e., relatch the cradle, the shaft 60 extension of the cradle pivot pin rotates in the counterclockwise direction. The transverse pin 66 engages the sides 64*b* of the crank recess 64, causing the crank 44 to be rotated in the counterclockwise direction as the cradle is swung around to its latched position. As the cradle reaches its latched or reset position, the parts of the accessory apparatus are in their positions shown in FIGS. 4 and 5 wherein the toggle constituted by link 46 and crank arm 44*b* are just short of being fully straightened. Latch lever 30 has latched up the trip slide 28, and both the trip spring 50 and the reset spring 54 are fully charged. With the cradle held in its latched position by the circuit breaker latch, clockwise rotation of the crank under the influence of reset spring 54 is prevented by shaft 60 and its cross pin 66. Consequently, the accessory apparatus 10 is held in its condition.

When latch lever 30 unlatches the trip slide to precipitate tripping of the breaker, the breaker cradle is released, and it abruptly swings to its tripped position under the influence of the breaker mechanism springs. By virtue of the reliefs 64*a* in crank 44, the accessory apparatus does not impede tripping movement of the breaker mechanism. Clockwise rotational restraint on crank 44 is thus removed, and reset spring 54 discharges to power the resetting of the accessory apparatus, with the parts returning to their reset positions seen in FIGS. 1 and 2.

To unlatch trip slide 28 pursuant to initiating an accessory trip function, shunt trip solenoid 12 is positionally mounted on platform 18 such that its plunger 12*a* is poised to impact against an upwardly turned tab 30*f* carried by an extension arm 30*g* of latch lever 30. It is seen that upon energization of solenoid 12, its plunger 12*a* engages tab 30*f* to pivot latch lever 30 in the counterclockwise direction seen in FIG. 4, thereby disengaging latch shoulder 30*b* from latch pin 36 to initiate tripping of the circuit breaker. As the breaker trips, reset spring 54 discharges to return the reset lever and trip slide to their reset positions. Latch spring 35 can then return the latch lever to its reset position with tab 30*f* picking up solenoid plunger 12*a* to return it to is retracted position.

If the three-coil shunt trip accessory trip function is desired, the solenoid 12 is mounted to platform 18 in place of shunt trip solenoid 12. However, if both shunt trip and three-coil shunt trip functions are desired, the three-coil shunt trip solenoid 14 is mounted behind shunt trip solenoid 12 with their plungers in axial alignment, as seen in FIG. 1. Thus, if a three-coil shunt trip function is signalled, solenoid 14 is energized and its plunger 14*a* impacts against the rearward end of shunt trip solenoid plunger 12*a* which, in turn, impacts against tab 30*f* of latch lever 30 to unlatch trip slide 28.

When the accessory apparatus package 10 is to be equipped with an undervoltage release (UVR) either in lieu of or in conjunction with one or both of the shunt trip solenoids 12 and 14, a UVR sub-assembly, generally indicated at 70 in FIG. 3, is mounted to platform 18. This sub-assembly includes a mounting bracket 72 of generally L-shaped configuration having an elevated platform segment 72a and a downturned side panel segment 72b terminating in a laterally turned foot 72c for attachment to the platform 18 by suitable means such as a screw. Platform segment 72a includes aperture 72d through which the upper reduced diameter portion of post 24 protrudes (FIG. 1) to complete the mounting of the UVR sub-assembly to the platform 18. UVR solenoid 16 is mounted to the elevated platform segment of bracket 72 so as to occupy a space generally above the space normally occupied by shunt trip solenoids 12 and 14. A vertically oriented lever 74 is pivotally mounted to the bracket side panel 72b by a pivot pin 76. The upper end of this lever is pinned to the exposed end of the UVR solenoid plunger 16a. A spring 78 has one end hooked through a hole in the upper end of lever 74, while its other end is threadedly engaged on a screw 80 extending through a hole formed in an upwardly turned flange extension 72d of bracket platform segment 72a.

It is thus seen that spring 78 biases lever 74 in the counterclockwise direction, as viewed in FIG. 3, to pull the UVR solenoid plunger 16a to an extended position. A lateral extending arm 74a integral with lever 74 engages the underside of bracket platform segment 72a to limit the degree of extension of plunger 16a. Screw 80 may be adjustably threaded into the end of spring 78 to establish a desired spring force acting on plunger 16a and lever 74.

The lower end of lever 74 terminates in a finger 74b which depends into operative relation with trip slide 28 and latch lever 30. Platform 18 is cut out at 18b so as to provide clearance for movement of finger 74b.

With the parts in their reset positions seen in FIGS. 1 and 2, it is noted that finger 74b of UVR lever 74 is engaged by the rearward edge 28h of lateral extension 28g of trip slide 28. This forces lever 74 to assume its clockwisemost position (FIG. 3) with the upper end of the lever forcing UVR solenoid plunger 16a to its fully seated position. This position is achieved by virtue of reset spring 54 overpowering the UVR spring 78. When the line voltage is at nominal level, the magnetic attraction of UVR solenoid 16 is sufficient to maintain its plunger seated against the bias of spring 78.

When the accessory apparatus 10 is armed incident to resetting of the breaker operating mechanism, trip slide 28 has moved forwardly to its latched position as seen in FIGS. 4 and 5, and the finger 74b of UVR lever 74 is left poised to engage an edge 30h of latch lever 30. If the line voltage drops below a predetermined minimum level, spring 78 becomes effective to overpower the magnetic force developed by the UVR trip solenoid 16, and plunger 16a is extended. Lever 74 is thus pivoted about its post 76 in the counterclockwise direction seen in FIG. 3. During the course of this movement of lever 74, its finger 74b engages edge 30h of latch lever 30, causing the latter to also pivot in the counterclockwise direction to unlatch trip slide 28 and precipitate tripping of the breaker. As the circuit breaker trips, the clockwise rotational restraint on crank 44 is removed, and reset spring 54 discharges to propel the parts back to their reset positions. As trip slide 28 returns to its reset position, its edge 28h engages finger 74b of UVR lever 74. This lever is thus pivoted in the clockwise direction (FIG. 3) to drive the UVR solenoid plunger 16a firmly back to its seated position. Return spring 54 is sufficiently powerful so that the reseating of the plunger 16a is done forcefully to thus ensure plunger reseating despite any counteracting frictional forces occasioned by dirt, wear, and misalignment.

It will be appreciated that if the line voltage has not returned to its nominal level when it is attempted to arm the accessory apparatus 10 by resetting the circuit breaker mechanism, the UVR return spring 78 will overpower the reduced magnetic force developed by the solenoid 16. Consequently, the finger 74b of UVR lever 74 will simply follow along with the trip slide as it is pulled forwardly via trip spring 50 as the reset lever 40 is pivoted counterclockwise by crank 44. The finger 74b ultimately engages the latch lever, pivoting it in the clockwise direction such that latch shoulder 30b is swung clear of latch pin 36. As a consequence, trip slide 28 continues on to its actuated position, picking up latch lever 30 and swinging paddle 56 into engagement with circuit breaker latch 58. The circuit breaker latch is thus disabled and cannot relatch the circuit breaker cradle, thereby defeating any attempt to reset the breaker mechanism. Consequently, the cradle is returned to its tripped position by the mechanism spring, and the clockwise rotational restraint on crank 44 is removed. Reset spring 54 then powers the various parts back to their reset positions, including plunger 16a back to its seated position.

When the line voltage returns to its nominal level, the magnetic force generated by the UVR solenoid 16 is sufficient to overpower return spring 78. Consequently, finger 74b of UVR lever 74 cannot follow the forward movement of trip slide 28 during rearming of the accessory apparatus. Consequently, the UVR lever does not engage latch lever 30, leaving latch shoulder 30b in position to engage latch pin 36. The latch lever thus acquires latching control of the trip slide, and the trip spring 50 is charged. The accessory apparatus is thus armed and ready to execute an accessory trip function when called for.

From the foregoing description, it is seen that the accessory apparatus of the present invention is capable of accommodating a plurality of diverse, auxiliary or accessory circuit breaker trip functions with a rather simple, compact construction of relatively few parts. As such, the various parts of the accessory apparatus can be mounted on a common support structure which can be readily accommodated within the breaker case. A signal feature of the invention is the automatic, self-resetting function performed by reset spring 54. This spring powers the movements of the various apparatus parts from their actuated to their reset positions rather than relying on the breaker mechanism springs to reset the accessory apparatus as in the above-mentioned U.S. Pat. No. 3,919,674. The return spring is of sufficient power as to readily overpower the UVR return spring 78, such that the UVR solenoid plunger 16a is forcefully returned to its seated position in snap-action fashion. Preferably, the seating of the plunger 16a within the UVR solenoid 16 serves as the ultimate stop establishing the reset position of the trip slide 28. Thus, reliable reseating of the UVR solenoid plunger 16a is always achieved with complete assurance.

It will also be observed that the present invention conveniently permits the adding on of additionally trip functions in the field. That is, the basic elements of the accessory apparatus can readily be augmented with one or both of the shunt trip solenoids 12 or 14, and/or the UVR sub-assembly 70 to implement the various trip functions as desired.

In the disclosed embodiment of the invention, latch lever 30, or more precisely paddle 56 carried by this lever, impacts the circuit breaker latch to precipitate tripping of the breaker. However, it will be appreciated that trip slide 28 or an extension thereof could just as well be responsible for providing the requisite tripping impact with the circuit breaker latch as the slide moves from its reset to its actuated position under the urgence of trip spring 50. In this modification, trip slide 28 need not engage latch lever 30 during movement to its actuated position.

It will thus be seen that the object set forth above, among those made apparent from the preceding description, are efficiently attained and, since certain changes may be made in the above construction without departing from the scope of the invention, it is intended that all matter contained in the above description or shown in the accompanying drawings shall be interpretative as illustrative and not in a limiting sense.

Having described our invention, what we claim as new and desire to secure by Letters Patent is:

1. Accessory apparatus for tripping an electric circuit breaker, said apparatus comprises, in combination:

A. a support for mounting attachment to the circuit breaker;

B. first and second members mounted by said support for individual movements between respective reset and actuated positions;

C. latch means carried by said second member for releasably latching said first member in its reset position while said second member assumes its reset position;

D. a third member mounted by said support for movement between actuated and reset positions;

E. a first spring connected between said first and third members, said first spring being charged while said first member is in its reset position and said third member is in its actuated position;

F. a second spring connected between said third member and said support, said second spring being charged while said third member is in its actuated position;

G. trip initiating means mounted on said support and operative to move said second member away from its reset position and thus unlatch said first member for movement to its actuated position under the influence of said first spring, the movement of said first member to its actuated position serving to initiate tripping of the circuit breaker; and H. means for coupling said third member to the breaker operating mechanism such as to achieve movement of said third member to its actuated position, and, upon tripping of the circuit breaker, said second spring discharges to restore said first, second and third members to their reset positions.

2. The apparatus defined in claim 1, which further includes a third spring connected between said support and said second member for biasing said second member to its reset position.

3. The apparatus defined in claim 2, which further includes tripping means carried by said second member for movement therewith into tripping engagement with a circuit breaker latch as said second member moves to its actuated position, and wherein said first member carries a tab disposed to engage and propel said second member to its actuated position as said first member is propelled to its actuated position by said first spring.

4. The accessory apparatus defined in claim 3, wherein said trip initiating means includes a trip solenoid having a plunger movable from a normal position to an actuated position upon energization of said solenoid, said plunger thereby engaging and moving said second member away from its reset position, and said second member includes means engaging said solenoid plunger to restore said plunger to its normal position as said second member is returned to its reset position under the bias of said third spring.

5. The accessory apparatus defined in claim 1, wherein said trip initiating means includes first and second trip solenoids mounted on said support with their plungers in end-to-end relation, whereby said plunger of said first trip solenoid acts directly on said second member and said plunger of said second trip solenoid acts on said second member through said plunger of said first trip solenoid in moving said second member away from its reset position.

6. The accessory apparatus defined in claim 1, wherein said third member carries an abutment positioned to engage said first member as said third member is returned to its reset position by said second spring, thereby to also return said first member to its reset position.

7. The apparatus defined in claim 1, wherein said coupling means comprises a crank having means accommodating driven engagement by the breaker operating mechanism, whereby upon resetting of the breaker operating mechanism, said crank is driven in a direction to propel said third member from its reset position to its actuated position and to hold said third member thereat against the bias of said second spring, and, upon tripping of the breaker, the operating mechanism releases said crank to enable said second spring to restore said first, second and third members to their reset positions.

8. The apparatus defined in claim 7, wherein said driven engagement accommodating means is relieved to decouple said crank from the breaker mechanism during tripping of the breaker.

9. The apparatus defined in claim 7, wherein said crank includes a crank arm pivotally interconnected to said third member by an intermediate link, said crank arm and said link constituting a toggle for converting resetting movement of the breaker mechanism into movement of said third member from its reset to its actuated position.

10. The apparatus defined in claim 9, wherein said toggle assumes a collapsed condition when said third member is in its reset position and a condition just short of a fully straightened condition when said third member is in its actuated position.

11. The apparatus defined in claim 1, wherein said first member is slideably mounted by said support, and said second and third members are pivotally mounted by said support.

12. The accessory apparatus defined in claim 1, wherein said trip initiating means inlcudes an undervoltage release sub-assembly comprising:

(1) a bracket secured to said support, (2) a solenoid mounted by said bracket and having a plunger movable between seated and extended positions, (3) a lever pivotally mounted to said bracket, said lever connected to said plunger for retention in a reset position by the magnetic force developed by said solenoid acting in response to energization by line voltage levels above a predetermined minimum to maintain said plunger in its seated position, (4) a return spring connected between said lever and said bracket and acting in opposition to said magnetic force to bias said plunger to its extended position and said lever to an actuated position, and (5) said lever engaging and moving said second member away from its reset position upon movement to its actuated position by said return spring.

13. The apparatus defined in claim 12, wherein said first member includes means engaging said lever to return said lever to its reset position and said plunger to its seated position as said first member is returned to its reset position by said second spring.

14. The apparatus defined in claim 13, wherein said first member is slideably mounted by said support, and said second and third members are pivotally mounted by said support, said third member and said lever being pivotally movable in planes parallel to each other and mutually perpendicular to the plane of pivotal movement of said second member.

15. The apparatus defined in claim 13, wherein said third member carries an abutment position to engage said first member as said third member is returned to its reset position by said second spring, thereby to also return said first member to its reset position.

16. The apparatus defined in claim 13, wherein said coupling means comprises a crank having means accommodating driven engagement by the breaker operating mechanism, whereby, upon resetting of the breaker operating mechanism, said crank is driven in a direction to propel said third member from its reset position to its actuated position and held thereat against the bias of said second spring, and, upon tripping of the breaker, the operating mechanism releases said crank to enable said second spring to restore said first, second and third members and said lever to their reset positions and said plunger to its seated position.

17. The apparatus defined in claim 16, wherein said driven engagement accommodating means is relieved to decouple said crank from the breaker mechanism during tripping of the breaker.

18. The apparatus defined in claim 17, wherein said crank includes a crank arm pivotally interconnected to said third member by an intermediate link, said crank arm and said link constituting a toggle for converting resetting movement of the breaker mechanism into movement of said third member from its reset to its actuated position.

19. The apparatus defined in claim 13, wherein said trip initiating means further includes a shunt trip solenoid mounted to said support and having a plunger movable from a normal position to an actuated position upon energization of said solenoid, said plunger thereby engaging and moving said second member away from its reset position, and said second member including means engaging said solenoid plunger to restore said plunger to its normal position as said second member is returned to its reset position.

20. The apparatus defined in claim 13, wherein said trip initiating means further includes first and second shunt trip solenoids mounted on said support with their plungers in end-to-end relation, whereby said plunger of said first shunt trip solenoid acts directly on said second member and said plunger of said second shunt trip solenoid acts on said second member through said plunger of said first shunt trip solenoid in moving said second member away from its reset position.

21. The apparatus defined in claim 19, wherein said support includes a generally planar platform elevated above said support, said undervoltage release solenoid being mounted on said platform such as to mount said undervoltage release solenoid in a position generally above the position of said shunt trip solenoid.

* * * * *